US008616390B2

(12) United States Patent
Kountotsis

(10) Patent No.: US 8,616,390 B2
(45) Date of Patent: Dec. 31, 2013

(54) TRIPLE CHAMBER BOTTLE AND METHOD OF MANUFACTURING THE SAME

(76) Inventor: Theodosios Kountotsis, East Elmhurst, NY (US)

( * ) Notice: Subject to any disclaimer, the term of this patent is extended or adjusted under 35 U.S.C. 154(b) by 780 days.

(21) Appl. No.: 12/291,610

(22) Filed: Nov. 12, 2008

(65) Prior Publication Data

US 2010/0116768 A1 May 13, 2010

(51) Int. Cl.
*B65D 37/00* (2006.01)

(52) U.S. Cl.
USPC ..... 215/6; 220/23.2; 220/23.4; 220/23.88; 220/522; 220/524; 220/252; 220/526; 222/129; 222/132; 222/136; 222/137; 222/142.3; 222/42; 222/48; 222/486; 222/94

(58) Field of Classification Search
USPC ..... 215/6, 366, 14, 205, 11.4, 11.1; 206/217, 222; 220/524, 526; 222/129, 222/132, 142.8, 42, 48
See application file for complete search history.

(56) References Cited

U.S. PATENT DOCUMENTS

| | | | | | |
|---|---|---|---|---|---|
| 311,415 | A | * | 1/1885 | Cleveland | 220/525 |
| 1,667,818 | A | * | 5/1928 | Page | 222/144.5 |
| 2,581,713 | A | * | 1/1952 | Roubicek | 222/144.5 |
| 3,211,343 | A | * | 10/1965 | Silver | 222/144.5 |
| 3,831,743 | A | * | 8/1974 | Leedy | 206/338 |
| 4,194,619 | A | * | 3/1980 | Schley | 206/217 |
| D276,271 | S | * | 11/1984 | Boris | D24/226 |
| 4,549,674 | A | * | 10/1985 | Alticosalian | 222/48 |
| 4,785,931 | A | * | 11/1988 | Weir et al. | 206/222 |
| 4,919,293 | A | * | 4/1990 | Buckley | 220/23.2 |
| 4,955,503 | A | * | 9/1990 | Propes | 220/526 |
| 4,971,211 | A | | 11/1990 | Lake | |
| 5,152,431 | A | * | 10/1992 | Gardner et al. | 222/136 |
| 5,332,157 | A | | 7/1994 | Proctor | |
| D361,509 | S | | 8/1995 | Dull et al. | |
| 5,497,920 | A | | 3/1996 | Moeller et al. | |
| 5,507,156 | A | | 4/1996 | Redmon | |
| 5,597,087 | A | | 1/1997 | Vinarsky | |
| 5,667,101 | A | | 9/1997 | Barrash et al. | |
| 5,758,786 | A | * | 6/1998 | John | 215/6 |
| 6,010,034 | A | | 1/2000 | Walthers | |
| 6,120,202 | A | | 9/2000 | Donsky | |
| 6,135,323 | A | | 10/2000 | Chen et al. | |
| 6,550,647 | B1 | | 4/2003 | Kunz | |
| 6,758,411 | B2 | | 7/2004 | Conway et al. | |
| D497,104 | S | | 10/2004 | Best et al. | |
| D507,738 | S | | 7/2005 | Wagner | |
| D510,529 | S | | 10/2005 | Yates, III | |
| 7,036,684 | B1 | | 5/2006 | Hantman et al. | |
| 7,331,478 | B2 | | 2/2008 | Aljadi | |
| 2004/0159625 | A1 | | 8/2004 | Kwon | |
| 2005/0109796 | A1 | | 5/2005 | Bourque et al. | |
| 2005/0184090 | A1 | | 8/2005 | DeJonge | |
| 2006/0021996 | A1 | | 2/2006 | Scott, III et al. | |
| 2006/0102581 | A1 | | 5/2006 | Yates, III | |
| 2007/0068963 | A1 | * | 3/2007 | Amron | 222/1 |
| 2008/0000866 | A1 | | 1/2008 | Yates, III | |
| 2008/0121654 | A1 | | 5/2008 | Pikowski | |
| 2008/0128378 | A1 | | 6/2008 | Nowzari | |

* cited by examiner

*Primary Examiner* — Anthony Stashick
*Assistant Examiner* — Cynthia Collado
(74) *Attorney, Agent, or Firm* — Theodosios Kountotsis

(57) ABSTRACT

A bottle including a body portion having a plurality of dividing walls extending from a base portion to a plurality of connection regions; a first chamber for holding a first liquid; a second chamber for holding a second liquid; a third chamber for holding a third liquid; and a removable cap; wherein a height of the plurality of dividing walls is less than an overall height of the body portion and the plurality of connection regions are configured to be a maximum height of the plurality of dividing walls.

21 Claims, 9 Drawing Sheets

TRIPLE CHAMBER BOTTLE AND METHOD OF MANUFACTURING THE SAME

BACKGROUND

1. Field of the Related Art

The present disclosure relates to bottles, and more particularly, but not exclusively, to a bottle having triple chambers for separately dispensing liquids.

2. Description of the Related Art

Liquid storage containers have been provided in numerous shapes and sizes for various liquid commodities. The most ubiquitous liquid storage containers are presently plastic and provide multiple shapes and sizes with mass production capability and recyclable materials. A popular liquid storage container is a drinking bottle. Typically, most individuals utilize a drinking bottle formed of a molded plastic material. The most common type of molded plastic drinking bottle employs a neck portion supporting a removable cap and a chamber connected to the neck portion. These plastic drinking bottles are reasonably durable, are reusable with most liquid drinks of choice, are economical to make and to purchase, and are easy to use (in that an individual can grip the bottle with one hand and take a drink via the outlet means without spilling the liquid).

In particular, sports bottles have become very popular over the years as molded plastic drinking bottles. Sports bottles are containers which generally have a removable lid, are relatively tall and easy to hold and have a cap or lid positioned at the top portion of the sports bottle. Sports bottles have become quite popular given the increased exercise activity of individuals. Sports bottles are convenient because they do not leak and can be readily carried or placed without fear of spilling the liquid contained therein. To use a sports bottle, one simply places the desired liquid in the sport bottle and closes the lid and/or inserts a straw. Thereafter, whenever it is desired to acquire liquid, one merely opens the lid to allow access to the liquid.

Many individuals who exercise are interested in workouts of extended durations, at various levels of intensity. Thus, many individuals have available or even carry several individual bottles of water or other liquids to replenish body liquids lost from sweating. These individuals may particularly seek to take more than one type of drink while maintaining the same exercise pace and without carrying multiple bottles containing different liquids. Thus, many individuals may desire more than one type of drink to replenish body liquids lost from sweating when engaging in one or more intense workout activities, without inadvertently mixing the liquids.

Furthermore, one of the most critical needs facing individuals engaged in sports is the continuous supply or intake of different liquids (e.g., drinking water, sports drinks, energy drinks, protein shakes, etc.) while they exercise. During extended exercise activities, individuals face serious dehydration problems and the loss of competitive capability unless they continuously replenish the fluids lost during such exercise activities. However, the human body requires many different types of vitamins or minerals that cannot all be found in one type of liquid. As a result, once again, individuals may desire more than one type of drink to replenish body liquids lost from sweating when engaging in one or more intense workout activities, without inadvertently mixing the liquids, in order to replenish several types of vitamins and minerals.

Moreover, sports enthusiasts are typically becoming more aware of the benefits of combining the use of electrolyte replacing sports drinks and/or water and/or protein shakes for ultimate performance enhancement and refreshment. Additionally, even children/teenagers often desire to consume more than a single flavor of soft drink or juices or any other type of desirable liquid. Also, adults who consume caffeinated energy drinks frequently purchase bottled water to compliment the energy drink in order to quench their thirst. In other words, such individuals must carry two or more bottles to quench their thirst. Thus, there is a need to provide a bottle that is capable of dispensing more than one type of liquid separately, without inadvertently mixing the liquids.

Consequently, traditional sports bottles present a limitation in that they do not allow an individual to enjoy a plurality of different liquid drinks separately from each other, without mixing the liquids, and at the same time period. Presently, many multi-chamber bottle systems lack the ability to effectively provide two or more liquids to an individual without mixing the liquid contents. In addition, another limitation is the fact that an individual must carry a plurality of bottles, each of the plurality of bottles containing different liquids. In addition, many individuals have a desire to combine the intake of liquids with the intake of solid supplements, such as energy bars, energy gels, vitamin supplements, etc.

Traditional multi-chamber bottles do not provide for effective means of purposely separating two or more liquids or a liquid and a non-liquid desired to be consumed by an individual. In other words, traditional multi-chamber bottles allow for inadvertent mixing of liquids, even though the individual desires to consume only one drink at a time. Thus, despite other practitioners' efforts to provide improved systems, there remains nonetheless a continuing need in the art for an improved liquid supply apparatus for use by individuals, such as, but not limited to, individuals engaged in sports or exercise activities.

The present disclosure is intended to overcome the drawbacks of conventional multi-chamber bottle systems by exploiting bottle morphology in order to successfully separate liquids without allowing inadvertent mixing of liquids. It is desirable to provide a single container having multiple elements for storage of different commodities and a means for selecting between them during consumption. It is further desirable that such a container be easily manufactured, filled, and assembled. In particular, the present disclosure relates to a bottle for separately providing two or more liquids to an individual, without mixing the liquids, via three compartments. The present disclosure further relates to a method of manufacturing a triple chamber bottle that prevents the inadvertent mixture of liquids.

SUMMARY

The present disclosure provides a bottle including a body portion having a plurality of dividing walls extending from a base portion to a plurality of connection regions; a first chamber for holding a first liquid; a second chamber for holding a second liquid; a third chamber for holding a third liquid; and a removable cap; wherein a height of the plurality of dividing walls is less than an overall height of the body portion and the plurality of connection regions are configured to be a maximum height of the plurality of dividing walls.

The present disclosure also provides a bottle including a body portion having a plurality of dividing walls extending from a base portion to a plurality of connection regions; a first chamber for holding a first liquid; a second chamber for holding a second liquid; a third chamber for holding a third liquid; and a removable and rotatable cap having a fixed orifice; wherein a height of the plurality of dividing walls is less than an overall height of the body portion and the plurality of connection regions are configured to be a maximum height of the plurality of dividing walls.

The present disclosure also provides a method for manufacturing a bottle including the steps of forming a body portion having a plurality of dividing walls extending from a base portion to a plurality of connection regions; forming a first chamber for holding a first liquid; forming a second chamber for holding a second liquid; forming a third chamber for holding a third liquid; and forming a removable cap; wherein a height of the plurality of dividing walls is less than an overall height of the body portion and the plurality of connection regions are configured to be a maximum height of the plurality of dividing walls.

The present disclosure also provides a method for manufacturing a bottle, the method including the steps of forming a body portion having a plurality of dividing walls extending from a base portion to a plurality of connection regions; forming a first chamber for holding a first liquid; forming a second chamber for holding a second liquid; forming a third chamber for holding a third liquid; and forming a removable and rotatable cap having a fixed orifice; wherein a height of the plurality of dividing walls is less than an overall height of the body portion and the plurality of connection regions are configured to be a maximum height of the plurality of dividing walls.

BRIEF DESCRIPTION OF THE DRAWINGS

Various embodiments of the present disclosure will be described herein below with reference to the figures wherein.

Figure 1:
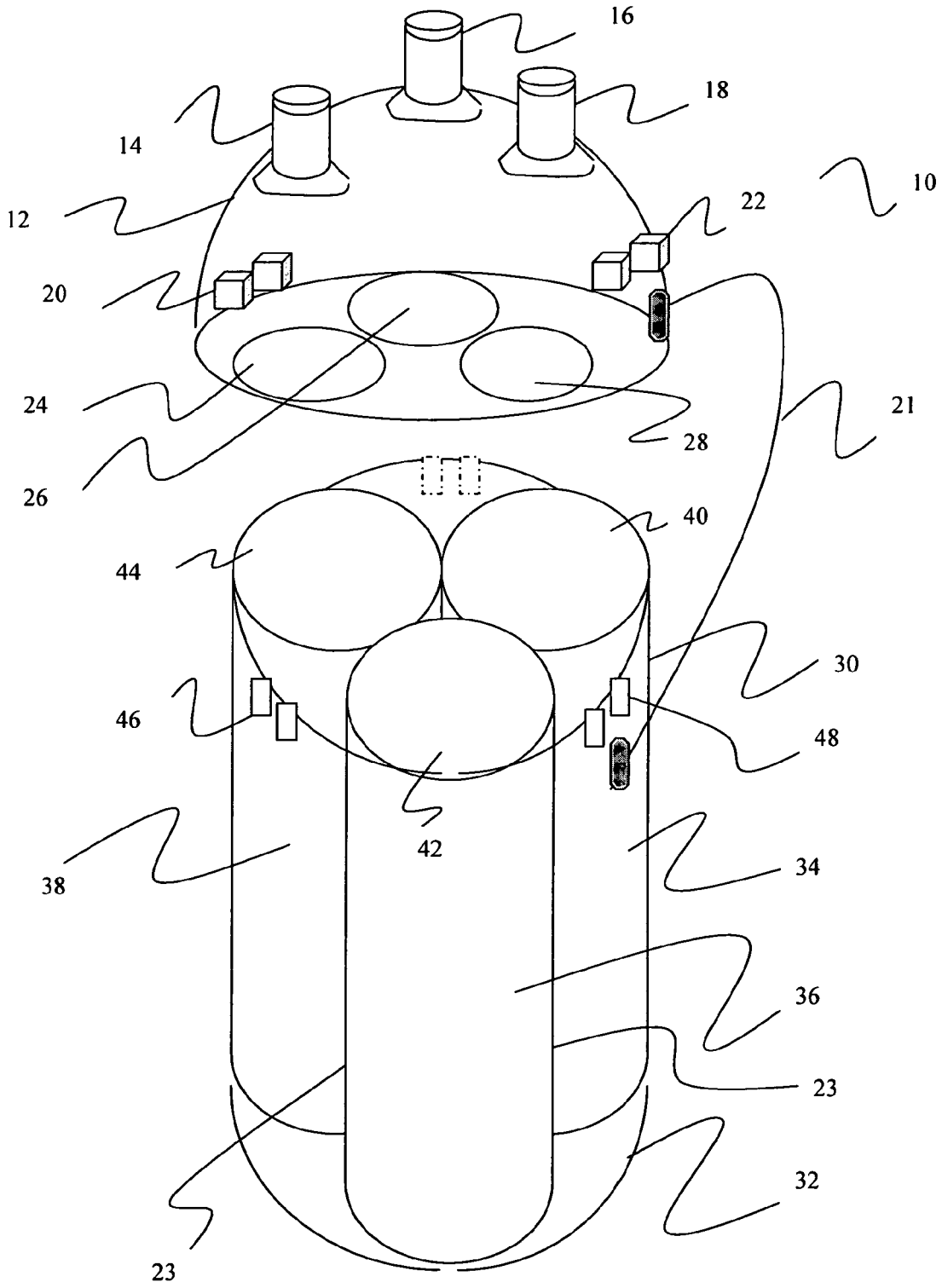
FIG. 1 is a perspective view of a triple-chambered drinking bottle having three orifices, in accordance with the present disclosure.

Further scope of applicability of the present disclosure will become apparent from the detailed description given hereinafter. However, it should be understood that the detailed description and specific examples, while indicating preferred embodiments of the present disclosure, are given by way of illustration only, since various changes and modifications within the spirit and scope of the invention will become apparent to those skilled in the art from this detailed description.

DETAILED DESCRIPTION

Unless otherwise indicated, all numbers expressing quantities and conditions, and so forth used in the specification and claims are to be understood as being modified in all instances by the term "about." In this application, the use of the singular includes the plural unless specifically stated otherwise. In this application, the use of "or" means "and/or" unless stated otherwise. Furthermore, the use of the term "including," as well as other forms, such as "includes" and "included," is not limiting. Also, terms such as "element" or "component" encompass both elements and components comprising one unit and elements and components that comprise more than one subunit unless specifically stated otherwise. The term "coupled to" means to be attached or connect to directly or indirectly or to be incorporated within.

As used in this description and in the appended claims, the word "container" does not necessarily refer to a rigid or a somewhat deformable structure, such as a "bottle," "bottle portion," or "bottle half" for containing liquid. Rather, the word "container" in the present disclosure and in the appended claims can also mean a "box," "packet," "bag," "portion of a bag," "pocket of a bag," or any such deformable structure for containing liquid.

As used in the present disclosure and in the appended claims, the word "channel" does not necessarily refer to a tunnel, straw, tube, bore, or other such elongated structure for conveying liquid. Rather, the word "channel" in this description and in the appended claims can also refer to an "opening," or any such structure for conveying liquid. As used in the present disclosure and in the appended claims, the word "chamber" can refer to a cup having an open mouth for drinking or can refer to an enclosed compartment having an opening or orifice for drinking.

The present disclosure proposes to provide an improved sports bottle. It is a more particular object of the present disclosure to provide an improved sports bottle which is quickly and easily refillable with two or three different liquids. It is a still more particular object of the present disclosure to provide an improved sports bottle which is quickly and easily refillable and which effectively prevents the mixture of liquids, by providing three separate chambers, when dispensed from the bottle by a user.

The present disclosure proposes to provide triple compartment pouches/chambers/channels suitable for selectively dispensing three different fluids (e.g., different beverages) from the same container. Such selective dispensing requires a chamber design that allows for manipulation of the compartments individually. This allows the consumer to selectively dispense and consume fluids separately, without the possibility of inadvertently mixing the liquids. The present disclosure also proposes a method for manufacturing a bottle having triple chambers that prevents the inadvertent mixing of liquids.

Reference will now be made in detail to embodiments of the present disclosure. While certain embodiments of the present disclosure will be described, it will be understood that it is not intended to limit the embodiments of the present disclosure to those described embodiments. To the contrary, reference to embodiments of the present disclosure is intended to cover alternatives, modifications, and equivalents as may be included within the spirit and scope of the embodiments of the present disclosure as defined by the appended claims.

Embodiments will be described below while referencing the accompanying figures. The accompanying figures are merely examples and are not intended to limit the scope of the present disclosure.

With reference to FIG. 1, there is presented a perspective view of a triple-chambered drinking bottle having three orifices, in accordance with the present disclosure. The cap portion of the triple chamber bottle 10 includes a cap 12, a first orifice 14, a second orifice 16, a third orifice 18, a first set of latching projections 20, a second set of latching projections 22, a first cap opening 24, a second cap opening 26, and a third cap opening 28. The body portion of the triple chamber bottle 10 includes a body 30, a base portion 32, a first chamber 34, a second chamber 36, a third chamber 38, a first bottle opening 40, a second bottle opening 42, a third bottle opening 44, a first set of orientation recesses 46, and a second set of orientation recesses 48. The body portion of the triple chamber bottle 10 further includes one or more dividing walls 23 and a lid strap 21.

Triple chamber bottle 10 includes a body 30 that is preferably formed of a hollow molded plastic material that defines three substantially cylindrical liquid chambers 34, 36, 38 and has a base portion 32. The bottle 10 includes a first chamber 34 for holding a first liquid (not shown), a second chamber 36 for holding a second liquid (not shown), and a third chamber 38 for holding a third liquid (not shown), where the first liquid, the second liquid, and the third liquid are preferably different liquids. It will be apparent to those skilled in the art that the diameters and/or heights of the first chamber 34, the second chamber 36, and the third chamber 38 and/or the body 30 may be selected in accordance with design preferences.

The one or more dividing walls 23 extend vertically from the base portion 32, extending through the body 30 and ending at one or more gap portions 312 (explained below) each forming two ridges (e.g., a first ridge 308 and a second ridge 310, described below with reference to FIG. 1A). The one or more dividing walls 23 provide a means for separating the first chamber 34 from the second chamber 36 and the third chamber 38. Applying pressure to one side of the body 30 allows the first liquid of the first chamber 34 to be forced out of the compartment and into the mouth of a user through the first orifice 14 (similarly for the second chamber 36 (second orifice 16) and the third chamber 38 (third orifice 18)). The dividing wall 23 prevents the pressure exerted on the first chamber 34 to be transferred to the second chamber 36 and the third chamber 38, thus allowing the user to selectively dispense the contents/liquids of each individual chamber/container/compartment into the mouth of a user via a channel (e.g., a first orifice 14, a second orifice 16, and a third orifice 18).

The cap 12 is molded into a dome shape including a first orifice 14, a second orifice 16, and a third orifice 18. The first orifice 14 is attached to a first connecting member (not shown, similar to FIG. 3, elements 62, 64) that extends through the dome-shape of the cap 12 up to a first cap opening 24. The second orifice 16 is attached to a second connecting member (not shown, similar to FIG. 3, elements 62, 64) that extends through the dome-shape of the cap 12 up to a second cap opening 26. The third orifice 18 is attached to a third connecting member (not shown, similar to FIG. 3, elements 62, 64) that extends through the dome-shape of the cap 12 up to a third cap opening 28. The dome-shaped cap 12 can be any reasonable and/or suitable size for securedly fitting onto the body 30 of the bottle 10.

The first cap opening 24 is designed so that it securedly fits onto the first bottle opening 40, the second cap opening 26 is designed so that it securedly fits onto the second bottle opening 42, and the third cap opening 28 is designed so that it securedly fits onto the third bottle opening 44. The cap 12 can be fixedly secured to the body 30 in only three ways in order to properly be affixed. As shown, the first orifice configuration (14, 24), the second orifice configuration (16, 26), and the third orifice configuration (18, 28) are fixed into the dome-shaped cap 12.

Additionally, an annular skirt (not shown) on the cap 12 may include a first set of latching projections 20 and a second set of latching projections 22. These latching projections 20, 22 allow the cap 12 to be fixedly secured to the body 30 of the bottle 10 via a first set of orientation recess 46 and a second set of orientation recess 48 located on the body 30. The latching projections 20, 22 may be spaced out as single units or may be spaced out as sets of two, three, or more. Any number of latching projections may be employed to secure the cap 12 to the body 30. The latching projections 20, 22 and the orientation recesses 46, 48 may be any shape or size contemplated by one skilled in the art.

In operation, the user of the triple chamber bottle 10 can conveniently draw a liquid from the bottle 10 through the orifices 14, 16, 18 while maintaining effective separation of the three liquids. In operation, the first orifice 14 would be placed in the mouth of a user, who would squeeze the bottle 10 to eject the first liquid from the first chamber 34. Alternately, the second orifice 16 would be placed in the mouth of a user, who would squeeze the bottle 10 to eject the second liquid from the second chamber 36. Alternately, the third orifice 18 would be placed in the mouth of a user, who would squeeze the bottle 10 to eject the third liquid from the third chamber 38.

In operation, the gap portion 312 (described below with reference to FIG. 1A) would separate the upper portions of each chamber 14, 16, 18 in order to prevent the inadvertent mixture of the three liquids. The separation of the first bottle neck (rim or first opening 304, see FIG. 1A) from the second bottle neck (rim or second opening 306, see FIG. 1A) via a gap portion 312 that may vary between a few millimeters to 1-2 inches, via the first ridge 308 and the second ridge 310, enables a user to drink two separate liquids, without mixing the liquids. Similarly, the same concept applied for dispensing three liquids. For example, one may wish to drink or have access to water, a protein shake, and an energy drink (e.g., Gatorade, Accelerade, Powerade, etc.).

Optionally, one or more bottle neck portions may be connected to the body 30 by means of one or more lid straps (e.g., lid strap 21) extending between the one or more bottle neck portions and the body 30. The one or more lid straps may provide for a permanent connection between the bottle neck portions and the body 30 so that the components remain connected to each other at all times.

Moreover, the first chamber 34 may have a different volumetric size than the second chamber 36. Furthermore, the first chamber 34 may have a different height than the second chamber 36. Also, the first chamber 34 may have a different volumetric size and/or height than the third chamber 38, and the third chamber 38 may have a different volumetric size and/or height than the second chamber 36. The widths, heights, and volumetric sizes of the first chamber 34, the second chamber 36, and the third chamber 38 may be adjusted according to design preferences and desired applications.

Figure 1A:
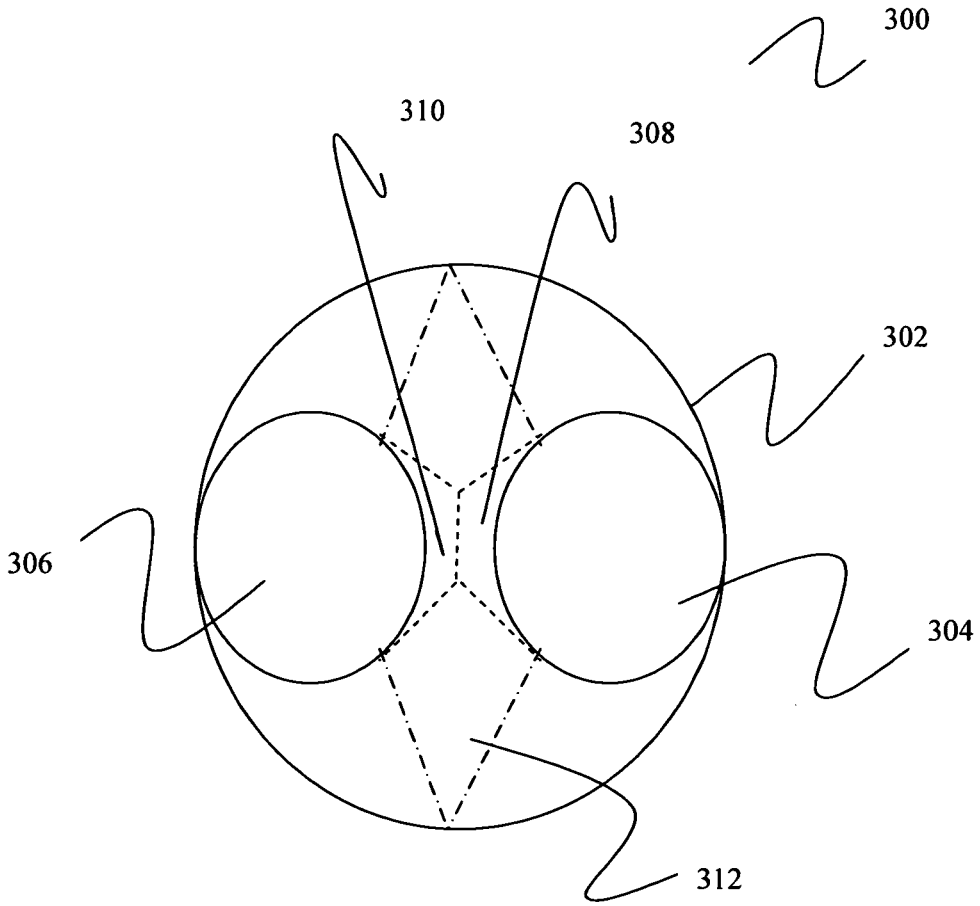
FIG. 1A is a top view of dual-chambers of the triple-chambered drinking bottle of FIG. 1, in accordance with the present disclosure.

With reference to FIG. 1A, there is presented a top view of dual-chambers of the triple-chambered drinking bottle of FIG. 1, in accordance with the present disclosure. The top view 300 of the dual chamber bottle 10 includes a top surface 302, a first opening 304, a second opening 306, a first ridge 308, a second ridge 310, and a gap portion 312.

The gap portion 312 provides for the effective separation of the first liquid contained in the first chamber 34 from the second liquid contained in the second chamber 36 and from the third liquid contained in the third container 38. It is envisioned that the gap portion 312 may be of any reasonable and/or suitable vertical or horizontal length and may be adapted to conform to the height of the first chamber 34 and/or the second chamber 36 and/or the third chamber 38.

The gap portion 312 prevents the fluid communication between the first chamber 34 and the second chamber 36 and the third chamber 38. The gap portion 312 allows for (i) fluid communication between the first chamber 34 and the first orifice 14, (ii) fluid communication between the second chamber 36 and the second orifice 16, and (iii) fluid communication between the third chamber 38 and the third orifice 18.

As a result of the gap portion 312, the upper portion of the first chamber 34 has a smaller width than the lower portion of the first chamber 34. In addition, as a result of the gap portion 312, the upper portion of the second chamber 36 has a smaller width than the lower portion of the second chamber 36. In addition, as a result of the gap portion 312, the upper portion of the third chamber 38 has a smaller width than the lower portion of the third chamber 38. The gap portion 312 allows for the height of the one or more dividing walls 23 to be less than the overall height of the body 30. Also, the connecting point of the first ridge 308 and the second ridge 310 (as shown in FIG. 1A) is configured to be a maximum height of the one or more dividing walls 23.

It is envisioned that the first, second, and third bottle openings 40, 42, 44 (the rims of the body 30) may wholly extend around the gap portions 312 or may extend partially around the gap portions 312. In other words, the outer perimeter of the gap portions 312 may have an outer wall enclosing the gap portions 312. The first, second, and third bottle openings 40, 42, 44 may extend wholly around the gap portions 312, the first chamber 34, the second chamber 36, and/or the third chamber 38 in order to better secure the cap 12.

FIG. 1A illustrates how the gap portion 312 separates the first opening 304 from the second opening 306 by providing for a first ridge 308 and a second ridge 310. The connecting point of the first ridge 308 and the second ridge 310 is the upper portion of the one or more dividing walls 23. The separation of the upper portions of the chambers 34, 36, 38 effectively provides for the separation of the three liquids when desired to be separately accessed by a user of the bottle 10. The first bottle opening 304 (the rim of the upper portion of the first chamber 34) and the second bottle opening 306 (the rim of the upper portion of the second chamber 36) are prevented from coming into contact with each other, thus forming a gap portion 312 to effectively separate the liquids during the storing and dispensing processes (similarly for the second chamber and the third chamber, and similarly for the third chamber and the first chamber). All three chambers 34, 36, 38 are interconnected in such a manner with a gap portion 312. All three chambers 34, 36, 38 may have one or more gap portions 312 to effectively separate the three liquids. In other words, the first, second, and third bottle openings 40, 42, 44 are separated from each other via one or more gap portions 312.

It will be apparent to those skilled in the art that this separation of the three liquids via the gap portions 312 offers a substantial advantage by providing the capability to drink more than one liquid without inadvertently mixing the three liquids.

Figure 2:
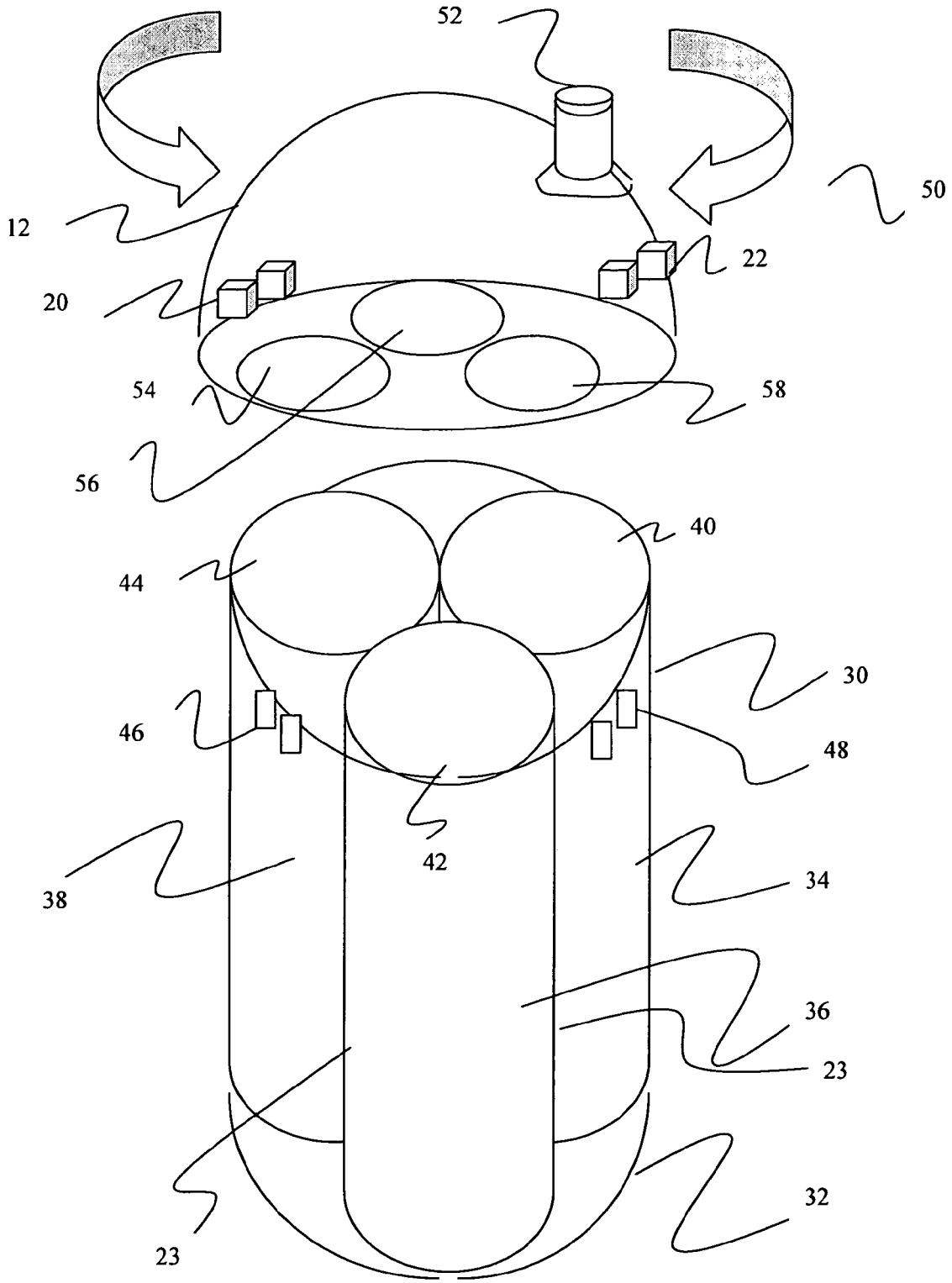
FIG. 2 is a perspective view of a triple-chambered drinking bottle having a rotatable cap with a single, fixed orifice, in accordance with the present disclosure.

With reference to FIG. 2, there is presented a perspective view of a triple-chambered drinking bottle having a rotatable cap with a single, fixed orifice, in accordance with the present disclosure, in accordance with the present disclosure. The bottle 50 includes a single orifice 52. Additionally, the triple chamber bottle 50 includes similar elements to FIG. 1. These similar elements include a cap 12, a first set of latching projections 20, a second set of latching projections 22, a first opening 24, a second opening 26, and a third opening 28. The body portion of the triple chamber bottle 10 includes a body 30, a base portion 32, a first chamber 34, a second chamber 36, a third chamber 38, a first bottle opening 40, a second bottle opening 42, a third bottle opening 44, a first set of orientation recesses 46, and a second set of orientation recesses 48.

In this second embodiment of the present disclosure, in contrast to FIG. 1, the orifice 52 is fixed on the cap 12 and there is only a single fixed orifice 52. In FIG. 1, the orifices 14, 16, 18 were fixed on the cap 30. However, there were three orifices 14, 16, 18. In contrast, in FIG. 2, the single orifice 52 is fixed and the cap 12 is movable or rotatable. In FIG. 1, the cap 12 can be affixed in 3 ways, but once affixed it cannot be rotated. In contrast, in FIG. 2, once the cap 12 is affixed, the cap 12 can be rotated to access each of the chambers 34, 36, 38 via one single orifice 52.

The movable and rotatable cap 12 can be affixed in three positions, where there is a first connection position, a second connection position, and a third connection position (not shown). The first connection position allows the cap 12 to be affixed in a position where the user can access the first liquid of the first chamber 34. The second connection position allows the cap 12 to be affixed in a position where the user can access the second liquid of the second chamber 34. The third connection position allows the cap 12 to be affixed in a position where the user can access the third liquid of the third chamber 38. The first connection position, the second connection position, and the third connection position can manipulate any type of connecting mechanism to connect the cap 12 to the body 30 (e.g., snapping mechanism, threaded mechanism, sliding mechanism, etc.).

Additionally, an annular skirt (not shown) on the cap 12 may include a first set of latching projections 20 and a second set of latching projections 22 (see FIG. 1). These latching projections 20, 22 allow the cap 12 to be fixedly secured to the body 30 of the bottle 50 via a first set of orientation recess 46 and a second set of orientation recess 48 located on the body 30. The latching projections 20, 22 may be spaced out as single units or may be spaced out as sets of two, three, or more. Any number of latching projections may be employed to secure the cap 12 to the body 30. The latching projections 20, 22 and the orientation recesses 46, 48 may be any shape or size contemplated by one skilled in the art.

As a result of the gap portion 312, the upper portion of the first chamber 34 has a smaller width than the lower portion of the first chamber 34. In addition, as a result of the gap portion 312, the upper portion of the second chamber 36 has a smaller width than the lower portion of the second chamber 36. In addition, as a result of the gap portion 312, the upper portion of the third chamber 38 has a smaller width than the lower portion of the third chamber 38. The gap portion 312 allows for the height of the one or more dividing walls 23 to be less than the overall height of the body 30. Also, the connecting point of the first ridge 308 and the second ridge 310 (as described above in FIG. 1A) is configured to be a maximum height of the one or more dividing walls 23.

Optionally, one or more bottle neck portions may be connected to the body 30 by means of one or more lid straps (e.g., lid strap 21) extending between the one or more bottle neck portions and the body 30. The one or more lid straps may provide for a permanent connection between the bottle neck portions and the body 30 so that the components remain connected to each other at all times.

Figure 3:
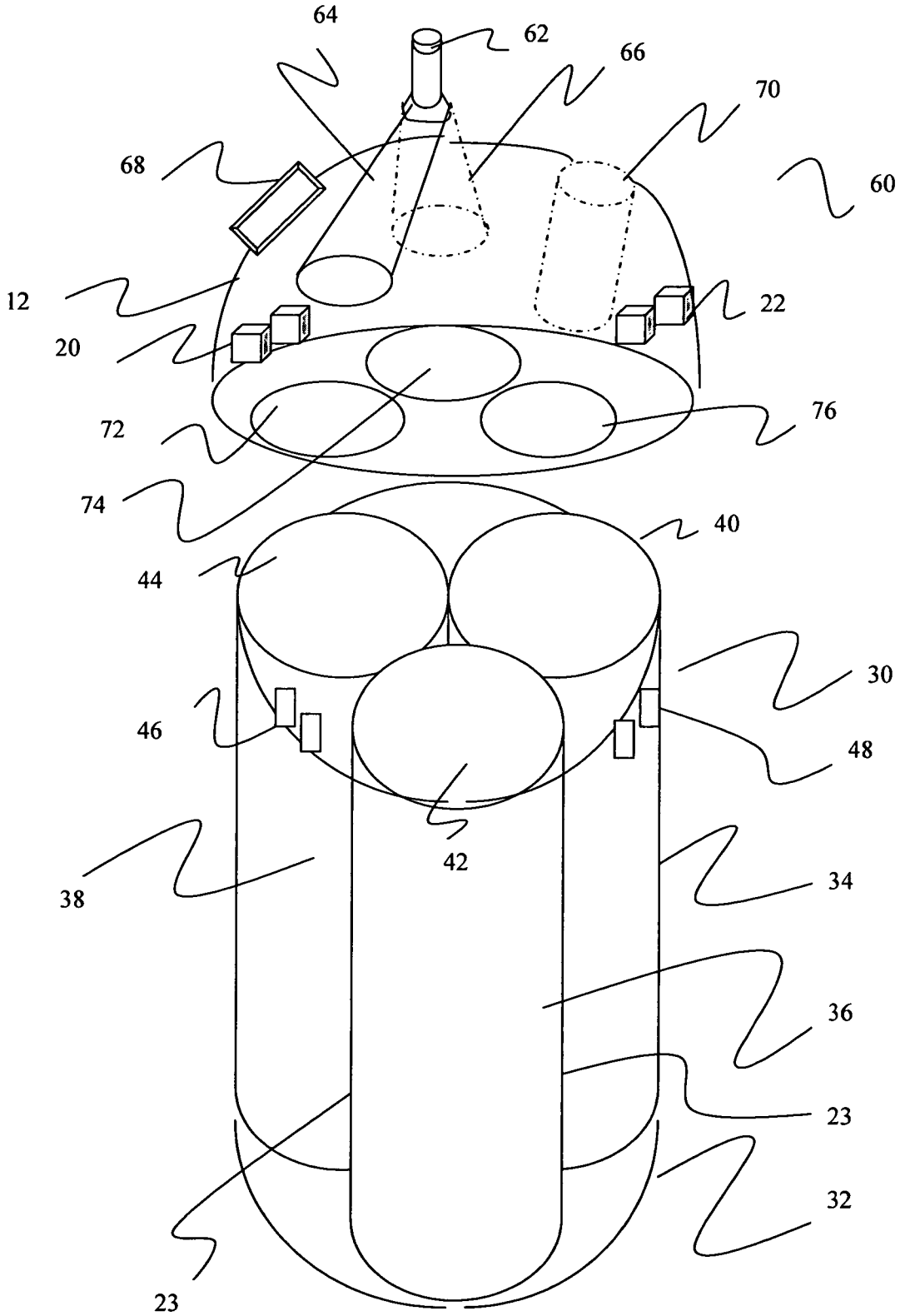
FIG. 3 is a perspective view of a triple-chambered drinking bottle having a switchable orifice and an opening to access a storage compartment, in accordance with the present disclosure.

With reference to FIG. 3, there is presented a perspective view of a triple-chambered drinking bottle having a switchable orifice and an opening to access a storage compartment, in accordance with the present disclosure. The bottle 60 includes an orifice 62, a first connecting position 64, a second connecting position 66, a switch 68, a tubular opening 70, a first cap opening 72, a second cap opening 74, and a third cap opening 76. Additionally, the triple chamber bottle 60 includes similar elements to FIG. 1. These similar elements include a cap 12, a second set of latching projections 22, a body 30, a base portion 32, a first chamber 34, a second chamber 36, a third chamber 38, a first bottle opening 40, a second bottle opening 42, a third bottle opening 44, a first set of orientation recesses 46, and a second set of orientation recesses 48.

In this second embodiment of the present disclosure, the orifice 62 is fixed on the cap 12. In FIG. 3, the orifice 62 is fixed and the cap 12 is also in a fixed position. The cap 12 can be affixed in one position, where there is a first connecting position 64 and a second connecting position 66. The first connecting position 64 allows the cap 12 to be affixed in a position where the user can access the first liquid of the first chamber 34. The second connecting position 66 allows the cap 12 to be affixed in a position where the user can access the second liquid of the second chamber 36. In this second embodiment, the first chamber 34 and the second chamber 36 hold liquids, whereas the third chamber 38 holds non-liquid substances (such as energy bars, energy gels, protein bars, etc.).

The cap 12 is molded into a dome shape including a single orifice 62. The orifice 62 is attached to a single connecting member that extends through the dome-shape of the cap 12 up to the first and second cap openings 72, 74. The connecting member can be moved from a first position 64 of the connecting member to a second position 66 of the connecting member. The first position 64 of the connecting member ends at a first cap opening 72 and the second position 66 of the connecting member ends at a second cap opening 74. The orifice 62 allows the user of the bottle 60 to access two liquids via the cap openings 72, 74 that are connected to the bottle openings 42, 44.

A switch 68 enables the connecting member to move between the first position 64 and the second position 66. The switch 68 may be mounted/located/positioned on any part of the surface of the dome-shaped cap 12. Preferably, the switch 68 is located on the lower edge of the bottom portion of the dome-shaped cap 12.

The dome-shaped cap 12 can be any reasonable and/or suitable size for securedly fitting onto the body 30 of the bottle 60. The first cap opening 72 is designed to be fixedly secured to the first bottle opening 42, the second cap opening 74 is designed to be fixedly secured to the second bottle opening 44, and the third cap opening 76 is designed to be fixedly secured to the tubular opening 70. The cap 12 can be fixedly secured to the body 30 in only one way in order to properly be affixed. In other words, the first cap opening 72 and the second cap opening 74 are designed to coincide with the first bottle opening 42 and the second bottle opening 74. The third cap opening 76 is designed to coincide with the tubular opening 70 to receive non-liquid items.

The orifice 62 remains in a fixed position on the dome-shaped cap 12. However, the connecting member shifts between two positions (i.e., between cap opening 72 and cap opening 74) in order to allow individual and separate access to first bottle opening 42 and second bottle opening 44. This configuration, as all other configurations of the present disclosure, in combination with the gap portion 312, prevents the inadvertent mixture of liquids.

As a result of the gap portion 312, the upper portion of the first chamber 34 has a smaller width than the lower portion of the first chamber 34. In addition, as a result of the gap portion 312, the upper portion of the second chamber 36 has a smaller width than the lower portion of the second chamber 36. In addition, as a result of the gap portion 312, the upper portion of the third chamber 38 has a smaller width than the lower portion of the third chamber 38. The gap portion 312 allows for the height of the one or more dividing walls 23 to be less than the overall height of the body 30. Also, the connecting point of the first ridge 308 and the second ridge 310 (as shown in FIG. 1A) is configured to be a maximum height of the one or more dividing walls 23.

Optionally, one or more bottle neck portions may be connected to the body 30 by means of one or more lid straps (not shown) extending between the one or more bottle neck portions and the body 30. The one or more lid straps may provide for a permanent connection between the bottle neck portions and the body 30 so that the components remain connected to each other at all times.

Figure 4:
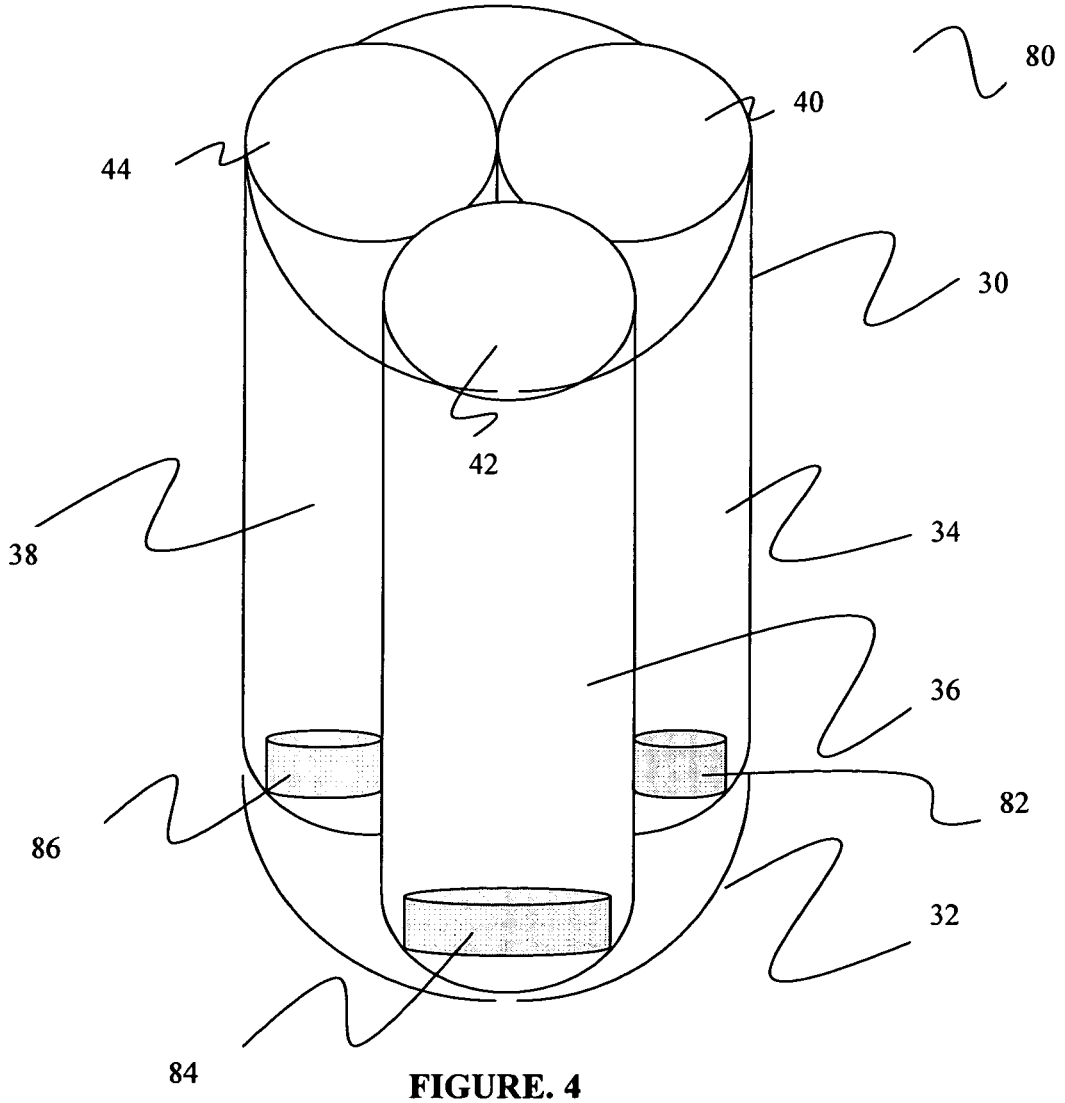
FIG. 4 is a perspective view of a triple-chambered drinking bottle having three cooling elements positioned at the bottom surface for each chamber of the bottle, in accordance with the present disclosure.

With reference to FIG. 4, there is presented a perspective view of a triple-chambered drinking bottle having three cooling elements positioned at the bottom surface for each chamber of the bottle, in accordance with the present disclosure. The bottle 80 includes a first cooling element 82, a second cooling element 84, and a third cooling element 86. Additionally, the triple chamber bottle 80 includes similar elements to FIG. 1. These similar elements include a body 30, a base portion 32, a first chamber 34, a second chamber 36, a third chamber 38, a first bottle opening 40, a second bottle opening 42, and a third bottle opening 44.

There are certain challenges that have developed in the use of sport bottles. For example, sport bottles are typically being utilized in an outdoor environment, which makes it very difficult to keep the contents cool. In most cases the sports bottle sits out in the sun or the hot air and rapidly loses the chilling effect of the liquid, with the result that an individual then have a warm liquid. This is highly undesirable as cool liquids are significantly more refreshing. In addition, with indoor health clubs/gyms being at room temperatures and warmer than preferred for a refreshing drink, many individuals may add ice to the drink to maintain it cooler. However, this can require time and effort in fitting the ice cubes individually into the bottle fill opening, and moreover dilutes all drinks other than water as the ice melts.

In FIG. 4 of the present disclosure, it is contemplated to use three cooling elements, a first cooling element 82, a second cooling element 84, and a third cooling element 86 positioned at the base portion 32 of the bottle 80. The first cooling element 82, the second cooling element 84, and the third cooling element 86 may be positioned in a separate compartment (single compartment or triple compartment) located at the bottom of the first chamber 34, the second chamber 36, and the third chamber 38, respectively, in order to cool the first liquid with the first cooling element 82, to cool the second liquid with the second cooling element 84, and to cool the third liquid with the third cooling element 86. In other words, each chamber 34, 36, 38 may include its own separate cooling element for cooling each liquid. It is noted that the cooling elements 82, 84, 86 may be removable cooling elements that can be replaced at any time by the user of the bottle 80. The cooling elements 82, 84, 86 may be any type of cooling elements contemplated by one skilled in the art.

Figure 5:
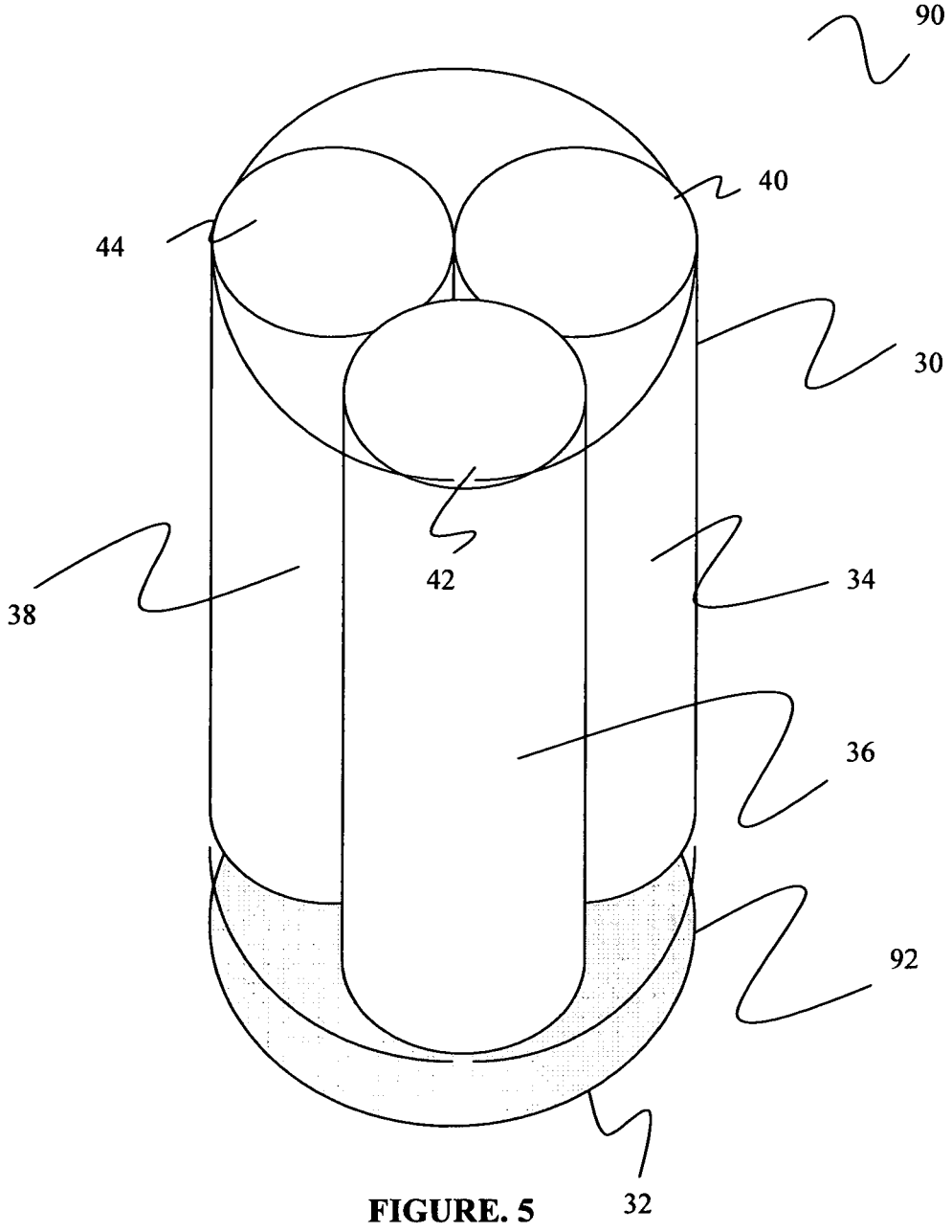
FIG. 5 is a perspective view of a triple-chambered drinking bottle having one single, common cooling element at the bottom surface of the bottle, in accordance with the present disclosure.

With reference to FIG. 5, there is presented is a perspective view of a triple-chambered drinking bottle having one single, common cooling element at the bottom surface of the bottle, in accordance with the present disclosure. The bottle 90 includes one single, uniform cooling element 92. Additionally, the triple chamber bottle 90 includes similar elements to FIG. 1. These similar elements include a body 30, a base portion 32, a first chamber 34, a second chamber 36, a third chamber 38, a first bottle opening 40, a second bottle opening 42, and a third bottle opening 44.

In FIG. 5 of the present disclosure, it is contemplated to use a single common cooling element 92 positioned at the base portion 32 of the bottle 90. The cooling element 92 may be positioned in a separate compartment located at the bottom of the first chamber 34, the second chamber 36 and the third chamber 38 in order to cool all three liquids at the same time. It is noted that the cooling element 92 may be a removable cooling element that can be replaced at any time by the user of the bottle 90. The cooling element 92 may be any type of cooling element contemplated by one skilled in the art.

Figure 6:
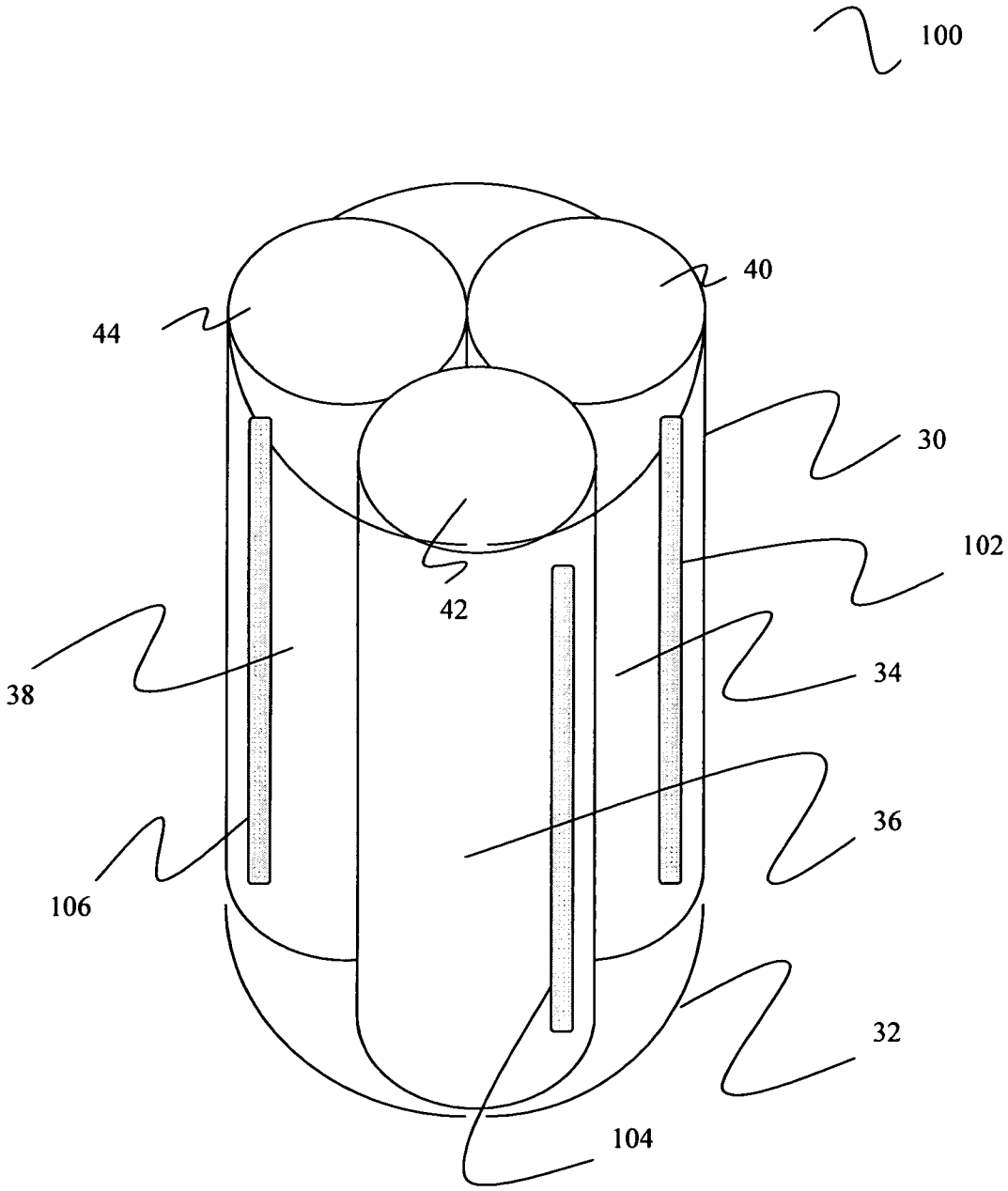
FIG. 6 is a perspective view of a triple-chambered drinking bottle including three cooling elements positioned on the side surfaces of each chamber of the bottle, in accordance with the present disclosure.

With reference to FIG. 6, there is presented a perspective view of a triple-chambered drinking bottle including three cooling elements positioned on the side surfaces of each chamber of the bottle, in accordance with the present disclosure. The bottle 100 includes a first cooling element 102, a second cooling element 104, and a third cooling element 106. Additionally, the triple chamber bottle 100 includes similar elements to FIG. 1. These similar elements include a body 30, a base portion 32, a first chamber 34, a second chamber 36, a third chamber 38, a first bottle opening 40, a second bottle opening 42, and a third bottle opening 44.

In FIG. 6 of the present disclosure, it is contemplated to use three cooling elements, a first cooling element 102, a second cooling element 104, and a third cooling element 106 positioned at the side portions of the bottle 100. The first cooling element 102, the second cooling element 104, and the third cooling element 106 may be positioned in a separate compartment located within the first chamber 34, the second chamber 36, and the third chamber 38, respectively, in order to cool the three liquids separately. In other words, each chamber 34, 36, 38 may include its own separate cooling element for cooling each liquid. It is noted that the cooling elements 102, 104, 106 may be removable (e.g., attachable or stick-on) cooling elements that can be replaced at any time by the user of the bottle 100. The cooling elements 102, 104, 106 may be any type of cooling elements contemplated by one skilled in the art.

Figure 7:
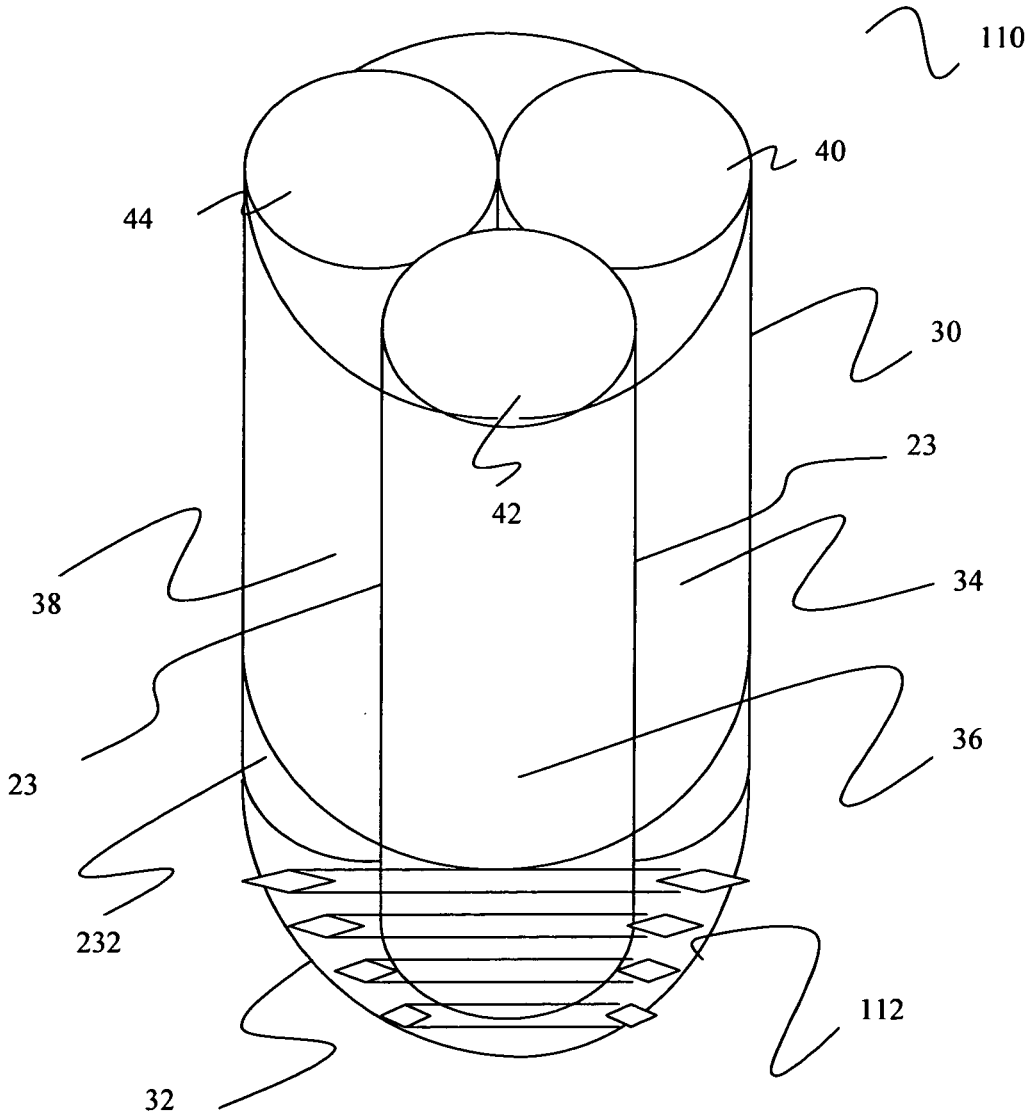
FIG. 7 is a perspective view of a triple-chambered drinking bottle including a collapsible portion at the bottom surface of the bottle, in accordance with the present disclosure.

With reference to FIG. 7, there is presented a perspective view of a triple-chambered drinking bottle including a collapsible portion at the bottom surface of the bottle, in accordance with the present disclosure. The bottle 110 includes a collapsible portion 112. Additionally, the triple chamber bottle 110 includes similar elements to FIG. 1. These similar elements include a body 30, a base portion 32, a first chamber 34, a second chamber 36, a third chamber 38, a first bottle opening 40, a second bottle opening 42, and a third bottle opening 44.

In FIG. 7, it is contemplated that the bottle 110 can have a collapsible portion 112 positioned at the base portion 32. The collapsible portion 112 may be split up into three collapsible portions, one for each chamber 34, 36, 38. The three collapsible portions may have a common top surface 232. When all three liquids fall below a predetermined threshold, the user of the bottle 110 may exert a force on the bottom surface of the base portion 32 and collapse/bend/shrink the bottle 110 up to the top surface 232. The top surface 232 may be designed to be positioned at any height of the bottle 110. Preferably, the height of the top surface 232 is positioned at or below the midpoint height of the bottle 110. The location of the top surface 232 may also depend on the length/height of the first chamber 34 and/or the length/height of the second chamber 36 and/or the length/height of the third chamber 38 and/or the height of the body 30. The three collapsible portions of each chamber 34, 36, 38 are preferably substantially flush with the side walls of body 30.

In operation, when all three liquids have been depleted or partially consumed by a user of the bottle 110, the user may exert as force and collapse/compress the base portion 32. The three liquids located in the collapsible portion 112 may channel into the top portions of the three chambers 34, 36, 38, respectively. In other words, the liquids in each of the chambers 34, 36, 38 move in a vertical, upward direction, as the user consumes the liquids in each chamber 34, 36, 38.

This embodiment is advantageous in shrinking the dimensions of the bottle 110 when it is desired to re-store the bottle 110. As described, the compression can occur when all three liquids have been depleted from each chamber 34, 36, 38, respectively. In other words, the present embodiment of the disclosure contemplates triple, simultaneous compression. However, one skilled in the art can contemplate a configuration that allows singular or dual compression of only one or two liquids depending on design preferences or aesthetics.

Figure 8:
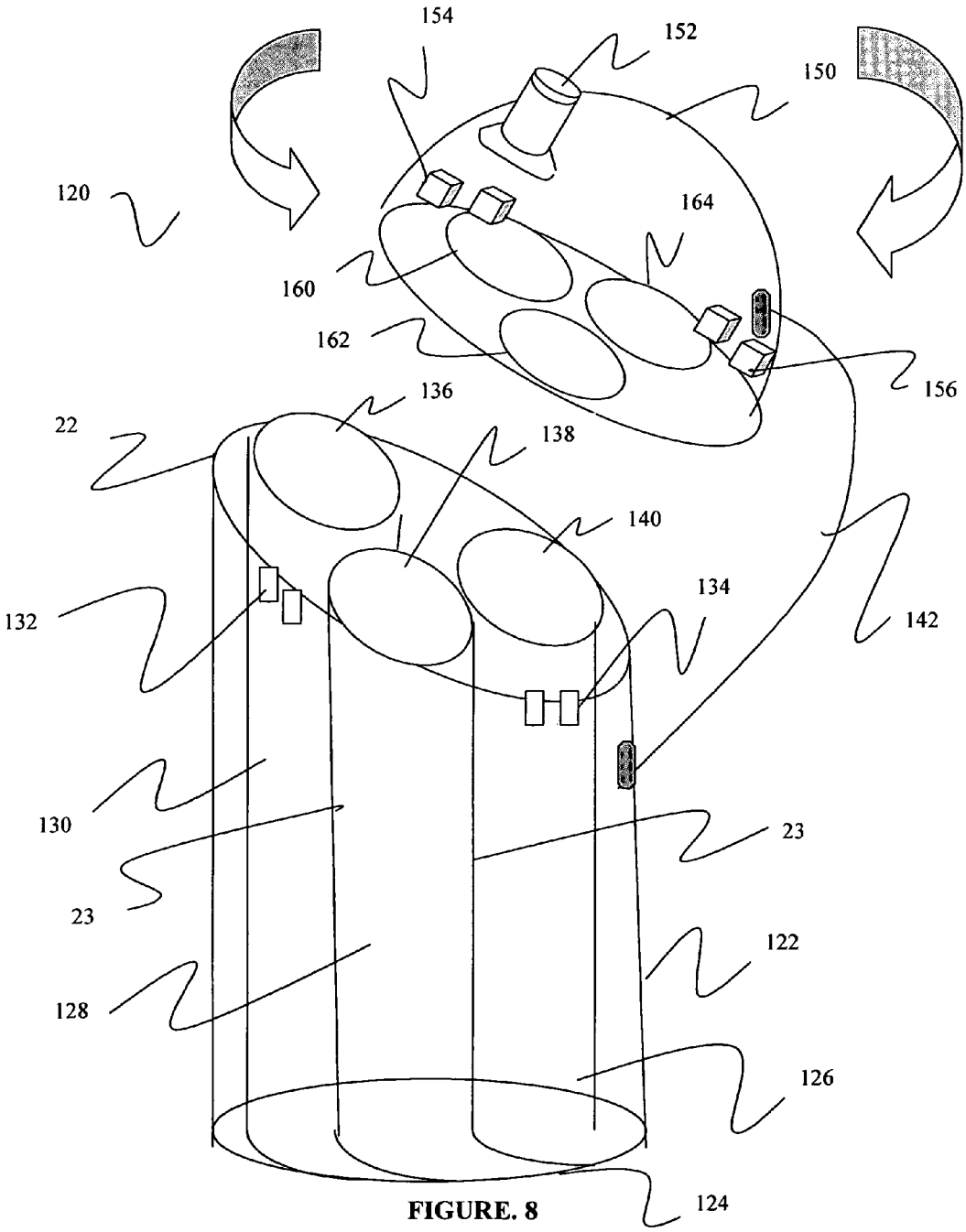
FIG. 8 is a perspective view of a triple-chambered drinking bottle including an oblique top surface, in accordance with the present disclosure.

With reference to FIG. 8, there is presented a perspective view of a triple-chambered drinking bottle including an oblique top surface, in accordance with the present disclosure. The bottle 120 includes a cap 150, an orifice 152, a first set of latching projections 154, a second set of latching projections 156, a first cap opening 160, a second cap opening 162, and a third cap opening 164. The bottle 120 further includes a body 122, a base portion 124, a first chamber 126, a second chamber 128, a third chamber 130, a first set of orientation recesses 132, a second set of orientation recesses 134, a first bottle opening 136, a second bottle opening 138, a third bottle opening 140, and a cap strap 142. The bottle 120 further includes one or more dividing walls 23 and a top portion 22.

Triple chamber bottle 120 includes a body 122 that is preferably formed of a hollow molded plastic material that defines three substantially cylindrical liquid chambers 126, 128, 130 and has a base portion 124. The bottle 120 includes a first chamber 126 for holding a first liquid, a second chamber 128 for holding a second liquid, and a third chamber 130 for holding a third liquid, where the three liquids are preferably different from each other (for example, water, protein shake, and sports drink). It will be apparent to those skilled in the art that the diameters and/or heights of the first chamber 126, the second chamber 128, and the third chamber 130 and/or the body 122 may be selected in accordance with design preferences or aesthetics.

The one or more dividing walls 23 extend vertically from the base portion 124, extending through the body 122 and ending at one or more gap portions 312 (explained above) each forming two ridges (e.g., a first ridge 308 and a second ridge 310, described below with reference to FIG. 1A). The one or more dividing walls 23 provide a means for separating the first chamber 126 from the second chamber 128 and the third chamber 130. Applying pressure to one side of the body 122 allows the first liquid of the first chamber 126 to be forced out of the compartment and into the mouth of a user through the orifice 152 (similarly for the second chamber 128 and the third chamber 130). The dividing wall 23 prevents the pressure exerted on the first chamber 126 to be transferred to the second chamber 128 and the third chamber 130, thus allowing the user to selectively dispense the contents/liquids of each individual chamber/container/compartment into the mouth of a user via a channel (e.g., single orifice 152).

The top portion 22 is preferably an oblique surface that can have an oblique cap 150 attached to it. The removable oblique cap 150 can include the rotatable orifice 152 for separately providing access to the first liquid of the first chamber 126, the second liquid of the second chamber 128, and the third liquid of the third chamber 130. The top portion 22 may be at a 30 degree angle with respect to the base portion 124. The top portion 22 may be at a 45 degree angle with respect to the base portion 124. The top portion 22 may be at any angle between 0 and 90 degrees with respect to the base portion 124.

The orifice 152 is rotatably movable between three positions, a first connecting position connecting the first cap opening 160 with the first bottle opening 136, a second connecting position connecting the second cap opening 162 with the second bottle opening 138, and a third connecting position connecting the third cap opening 164 with the third bottle opening 140. The first connecting position, the second connecting position, and the third connection position may be employed by any type of connecting mechanism (e.g., a snapping mechanism, etc.). By rotating the cap 150, a user may use a single orifice 152 to access each chamber 126, 128, 130 individually. The orifice 152 automatically clicks into place (i.e., into either the first connecting position, the second connecting position, or the third connecting position) when the user rotates the cap 150 of the bottle 120. The cap 150 can be affixed in only three positions when it is rotated.

Additionally, an annular skirt (not shown) on the cap 150 may include a first set of latching projections 154 and a second set of latching projections 156. These latching projections 154, 156 allow the cap 150 to be fixedly secured to the body 122 of the bottle 120 via a first set of orientation recess 132 and a second set of orientation recess 134 located on the body 122. The latching projections 154, 156 may be spaced out as single units or may be spaced out as sets of two, three, or more. Any number of latching projections may be employed to secure the cap 150 to the body 122. The latching projections 154, 156 and the orientation recesses 132, 134 may be any shape or size contemplated by one skilled in the art.

It is envisioned that the first, second, and third bottle openings 136, 138, 140 (the rims of the body 122) may wholly extend around the gap portions 312 or may extend partially around the gap portions 312. In other words, the outer perimeter of the gap portions 312 may have an outer wall enclosing the gap portions 312. The first, second, and third bottle openings 136, 138, 140 may extend wholly around the gap portions 312, the first chamber 126, the second chamber 128, and/or the third chamber 130 in order to better secure the cap 150.

Optionally, one or more bottle neck portions may be connected to the body 122 by means of one or more lid straps (e.g., cap strap 142) extending between the one or more bottle neck portions and the body 122. The one or more lid straps may provide for a permanent connection between the bottle neck portions and the body 122 so that the components remain connected to each other at all times.

It will be apparent to those skilled in the art that this separation of liquids via the gap portion 312 offers a substantial advantage by providing the capability to drink more than one liquid without inadvertently mixing the three liquids.

Moreover, while threaded connections are utilized to connect various components in the described embodiments, many other forms of connections, such as snap together connections, twist-to-lock connections and the like also can be utilized. The present disclosure may also include a twist-on or snap-on spout or nozzle, preferably of a tapered conical or substantially cylindrical shape, and internally divided. The spout or nozzle may be adapted to be sealed by an end cap, a plug, by helically twisting the "overcap" upon a "scaling rod", or by sliding upon an internal shaft affecting a seal when screwed or pushed downwards towards the bottle.

Optionally, the body of all bottles of the present disclosure may be constructed of a clear or transparent or translucent material in order to better identify the liquid contained within the first chamber, the second chamber, and the third chamber.

Additionally, all the bottles of the present disclosure are not limited to any particular bottle shape or design. Although the bottles are described and depicted herein as being of generally cylindrical upstanding form, the configurations of the containers is a matter of design choice. The use of generally cylindrical containers is described because it gives the sports bottle a readily acceptable appearance and shape, and because generally cylindrical container shapes tend to work well if one also desires to make use of generally cylindrical, externally threaded container necks. Moreover, generally cylindrical containers tend to efficiently provide good fluid-carrying capacity at relatively low manufacturing cost. While opaque, single-thickness materials may be preferred for use, transparent or plural-layer materials may be used, if desired, to enhance visibility, to provide added insulating capability, or for other purposes.

Moreover, the first chamber, the second chamber, and the third chamber of all the bottles of the present disclosure may be designed to contain different ratios of liquids. For example, a 50/50 ratio between the first chamber and the second chamber may be preferred. However, it is envisioned that even a 1/3 to 2/3 ratio may be practical for certain applications.

Furthermore, all the bottles of the present disclosure may include one or more caps or lids, and each of the one or more caps or lids may have a strap connected to the body. All the bottles of the present disclosure may include one or more cooling elements to cool the liquids contained within the chambers or containers. All the bottles of the present disclosure may include one or more collapsible portions to bend the chamber or containers. All the bottles of the present disclosure may be of different widths and/or heights, and each chamber of all the bottles may be of a different width and/or height. All the bottles of the present disclosure may have different caps of different shapes and/or sizes with a plurality of fastening means. All the bottles of the present disclosure may include slidable orifices moving on a slidable track in a variety of tracks. All the bottles of the present disclosure may have interchangeable parts. All the bottles of the present disclosure may have gap portions between the chambers to effectively separate the liquids. The gap portion between each of the chambers is described with reference to FIG. 1A.

Finally, all the bottles of the present disclosure may be constructed by any manufacturing means. For example, blow molding technology may be utilized. A plurality of different types of thermoplastic resins may be utilized in any type of blow molding techniques.

Accordingly, the present disclosure prevents the mixing of contents of multiple chambers during the dispensing process, thus minimizing or even eliminating the risk that two or three liquids are simultaneously dispensed in an inadvertent manner.

It will be understood that there are to be no limitations as to the dimensions and shape of the beverage bottle, including the storage compartment, or the materials from which the beverage bottle is manufactured. The bottles may be constructed to resemble any commercially available bottle for holding a liquid beverage and may be manufactured from any suitable plastic, glass or metal material. Furthermore, it should be understood that the beverage bottle of the present disclosure may be adapted to store any suitable liquid, such as, for example, water, juice, milk, carbonated sodas, protein shakes, energy drinks, beer, wine, and liquor.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

Having described the invention above, various modifications of the techniques, procedures, material and equipment will be apparent to those in the art. It is intended that all such variations within the scope and spirit of the appended claims be embraced thereby.

The foregoing examples illustrate various aspects of the invention and practice of the methods of the invention. The examples are not intended to provide an exhaustive description of the many different embodiments of the invention. Thus, although the foregoing invention has been described in some detail by way of illustration and example for purposes of clarity and understanding, those of ordinary skill in the art will realize readily that many changes and modifications can be made thereto without departing form the spirit or scope of the invention.

What is claimed is:

1. A drinking bottle for dispensing a plurality of liquids, the thinking bottle comprising:

a body portion;

a first circular chamber for holding a first liquid;

a second circular chamber for holding a second liquid;

a third circular chamber for holding a third liquid, the first, second, and third circular chambers disposed within the body portion such that only a portion of a sidewall of each chamber abuts a portion of a sidewall of the other chambers; and a removable and rotatable cap having a single fixed orifice non-centrally disposed on an outer surface thereon, the removable and rotatable cap configured to be removably connected directly on top surfaces of the first, second, and third chambers, without intermediate components therebetween, such that the single fixed orifice is configured to swivel in conjunction with rotation of the cap to facilitate alignment of the single fixed orifice with one of three openings defined on a bottom portion of the removable and rotatable cap, the three openings configured to be flush with the top surfaces of the first, second, and third chambers;

wherein the first, second, and third liquids are selectively dispensed from the first, second, and third chambers, respectively, upon compression of the sidewalls of the first, second, and third chambers, respectively; and wherein outer surfaces of the first, second, and third circular chambers are configured and dimensioned to create a central gap region within the body portion and between central non-abutting portions of the outer surfaces of the first, second, and third circular chambers, the central gap region being devoid of the plurality of liquids.

2. The bottle according to claim 1, wherein the removable and rotatable cap is configured to be parallel to the base portion of the bottle.

3. The bottle according to claim 1, wherein the removable and rotatable cap is actuable in an oblique position with respect to the base portion of the bottle.

4. The bottle according to claim 1, wherein an upper portion of the first chamber is separated from an upper portion of the second chamber and an upper portion of the third chamber by the central gap region.

5. The bottle according to claim 1, wherein the single fixed orifice non-centrally disposed on an outer surface of the cap is configured to engage a mouth of a subject for selectively receiving the first, second, and third liquids.

6. The bottle according to claim 1, wherein the single fixed orifice non-centrally disposed on an outer surface of the cap is constructed in a substantially parallel configuration with respect to the body portion of the bottle, the single fixed orifice protruding from the removable and rotatable cap.

7. The bottle according to claim 1, wherein the cap is dome-shaped.

8. The bottle according to claim 1, wherein partially abutting relationships between the first, second, and third circular chambers further create multiple non-central gap regions across a periphery of the body portion, the non-central gap regions devoid of the first, second, and third liquids.

9. The bottle according to claim 8, wherein the multiple non-central gap regions across the periphery of the body portion are separate and distinct from each other.

10. The bottle according to claim 8, wherein the multiple non-central gap regions across the periphery of the body portion are four discontinuous regions.

11. The bottle according to claim 1, wherein a single outer rim circumferentially extends around the body portion of the bottle where top portions of the first, second, and third circular chambers connect thereto.

12. A method for manufacturing a drinking bottle for dispensing a plurality of liquids, the method comprising the steps of:

forming a body portion;

forming a first circular chamber for holding a first liquid;

forming a second circular chamber for holding second liquid;

forming a third circular chamber for holding a third liquid, the first, second, and third circular chambers disposed within the body portion such that only a portion of a sidewall of each chamber abuts a portion of a sidewall of the other chambers; and forming a removable and rotatable cap having a single fixed orifice non-centrally disposed on an outer surface thereon, the removable and rotatable cap configured to be removably connected directly on top surfaces of the first, second, and third chambers, without intermediate components therebetween, such that the single fixed orifice is configured to swivel in conjunction with rotation of the cap to facilitate alignment of the single fixed orifice with one of three openings defined on a bottom portion of the removable and rotatable cap, the three openings configured to be flush with the top surfaces of the first, second, and third chambers;

wherein the first, second, and third liquids are selectively dispensed from the first, second, and third chambers, respectively, upon compression of the sidewalls of the first, second, and third chambers, respectively; and wherein outer surfaces of the first, second, and third circular chambers are configured and dimensioned to create a central gap region within the body portion and between central non-abutting portions of the outer surfaces of the first, second, and third circular chambers, the central gap region being devoid of the plurality of liquids.

13. The method according to claim 12, further comprising forming the removable and rotatable cap in a substantially parallel configuration with respect to the base portion of the bottle.

14. The method according to claim 12, further comprising actuating the removable and rotatable cap in an oblique position with respect to the base portion of the bottle.

15. The method according to claim 12, further comprising permitting a mouth of a subject to engage the single fixed orifice non-centrally disposed on an outer surface of the cap for selectively receiving the first, second, and third liquids.

16. The method according to claim 12, further comprising constructing the single fixed orifice non-centrally disposed on an outer surface of the cap in a substantially parallel configuration with respect to the body portion of the bottle, the single fixed orifice protruding from the removable and rotatable cap.

17. The method according to claim 12, further comprising constructing the cap in a dome-shaped configuration.

18. The method according to claim 12, wherein partially abutting relationships between the first, second, and third circular chambers further create multiple non-central gap regions across a periphery of the body portion, the non-central gap regions devoid of the first, second, and third liquids.

19. The method according to claim 18, wherein the multiple non-central gap regions across the periphery of the body portion are separate and distinct from each other.

20. The method according to claim 18, wherein the multiple non-central gap regions across the periphery of the body portion are four discontinuous regions.

21. The method according to claim 12, wherein a single outer rim circumferentially extends around the body portion of the bottle where top portions of the first, second, and third circular chambers connect thereto.

* * * * *